US011052699B2

(12) United States Patent
Votino et al.

(10) Patent No.: US 11,052,699 B2
(45) Date of Patent: Jul. 6, 2021

(54) MULTICOLOR MARKER ASSEMBLY

(71) Applicants: Anna Votino, Sacramento, CA (US); Vanessa DeMartini, Sacramento, CA (US)

(72) Inventors: Anna Votino, Sacramento, CA (US); Vanessa DeMartini, Sacramento, CA (US)

( * ) Notice: Subject to any disclaimer, the term of this patent is extended or adjusted under 35 U.S.C. 154(b) by 0 days.

(21) Appl. No.: 16/680,156

(22) Filed: Nov. 11, 2019

(65) Prior Publication Data

US 2021/0138825 A1 May 13, 2021

(51) Int. Cl.

| | |
|---|---|
| ***B43K 27/04*** | (2006.01) |
| ***B43K 8/03*** | (2006.01) |
| ***B43K 23/12*** | (2006.01) |
| ***B43K 8/02*** | (2006.01) |
| ***B43K 27/00*** | (2006.01) |
| *A63F 3/06* | (2006.01) |

(52) U.S. Cl.

CPC ..... *B43K 8/03* (2013.01); *B43K 8/02* (2013.01); *B43K 23/12* (2013.01); *B43K 27/003* (2013.01); *A63F 3/062* (2013.01)

(58) Field of Classification Search

CPC ..... B43K 8/02; B43K 8/03; B43K 27/003

USPC ..... 401/23, 35, 36

See application file for complete search history.

(56) References Cited

U.S. PATENT DOCUMENTS

| | | | | |
|---|---|---|---|---|
| 3,887,287 | A * | 6/1975 | Rosh, Jr. | B43K 27/08 401/35 |
| 4,795,156 | A * | 1/1989 | Paulish | A63F 3/06 273/148 R |
| 5,368,405 | A | 11/1994 | Sixiong | |
| 5,419,592 | A | 5/1995 | Stuart | |
| 5,713,681 | A | 2/1998 | Venne | |
| D396,244 | S | 7/1998 | Venne | |
| 6,554,517 | B2 | 4/2003 | Ahmed | |
| 6,739,779 | B1 * | 5/2004 | Deeds | B43K 8/02 222/129 |
| 6,913,405 | B2 * | 7/2005 | Fischer | A45D 34/04 220/669 |
| 6,953,296 | B1 * | 10/2005 | Vora | B43K 8/003 401/35 |
| 6,997,631 | B2 * | 2/2006 | Yamada | A45D 34/042 401/198 |
| 8,393,816 | B1 * | 3/2013 | Schumacher | B43K 8/003 401/133 |
| 8,403,577 | B2 * | 3/2013 | Khoshnevis | B43K 27/00 401/35 |

(Continued)

FOREIGN PATENT DOCUMENTS

WO WO0115912 3/2001

*Primary Examiner* — Jennifer C Chiang

(57) ABSTRACT

A multicolor marker assembly for making a multicolored mark on a bingo card includes a bottle that has a plurality of chambers being integrated therein. Each of the chambers contains a fluid pigment of a respective color. An applicator is removably coupled to the bottle and the applicator is comprised of a fluid permeable material to absorb the fluid pigment contained in each of the chambers. Additionally, the applicator releases the fluid pigment in each of the chambers when the applicator is pressed against a surface to make a mark comprising a plurality of colors. A cap is positionable over the applicator to inhibit the applicator from releasing the fluid pigments.

7 Claims, 5 Drawing Sheets

(56) References Cited

U.S. PATENT DOCUMENTS

| | | | |
|---|---|---|---|
| 9,826,815 | B2 | 11/2017 | Pires |
| 2002/0076254 | A1 | 6/2002 | Calabro |
| 2002/0127045 | A1 | 9/2002 | Cookfair |

* cited by examiner

MULTICOLOR MARKER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to marker devices and more particularly pertains to a new marker device for making a multicolored mark on a bingo card.

(2) Description of Related Art Including Information Disclosed Under 37 CFR 1.97 and 1.98

The prior art relates to marker devices.

BRIEF SUMMARY OF THE INVENTION

An embodiment of the disclosure meets the needs presented above by generally comprising a bottle that has a plurality of chambers being integrated therein. Each of the chambers contains a fluid pigment of a respective color. An applicator is removably coupled to the bottle and the applicator is comprised of a fluid permeable material to absorb the fluid pigment contained in each of the chambers. Additionally, the applicator releases the fluid pigment in each of the chambers when the applicator is pressed against a surface to make a mark comprising a plurality of colors. A cap is positionable over the applicator to inhibit the applicator from releasing the fluid pigments.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
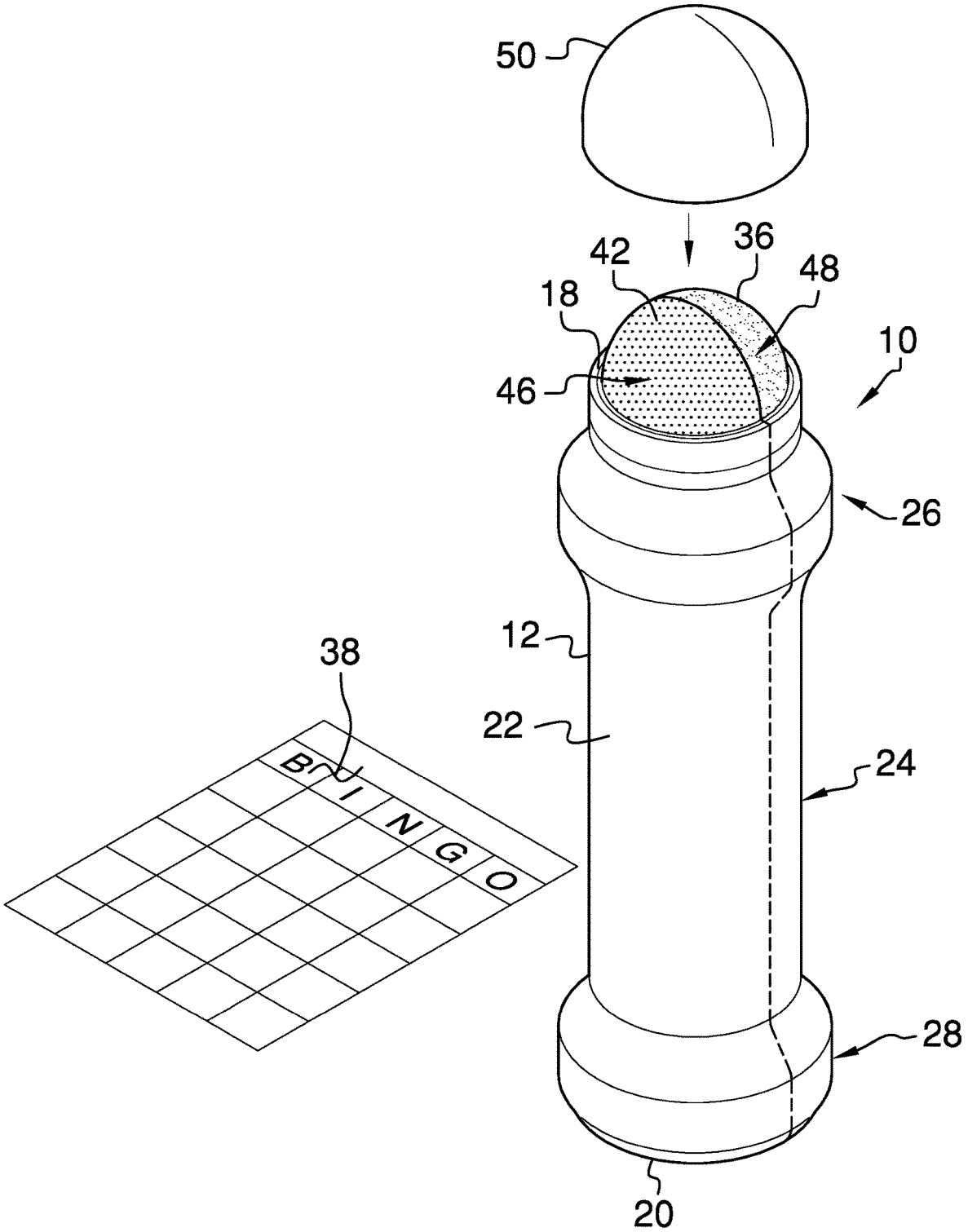
FIG. 1 is a perspective view of a multicolor marker assembly according to an embodiment of the disclosure.
Figure 2:
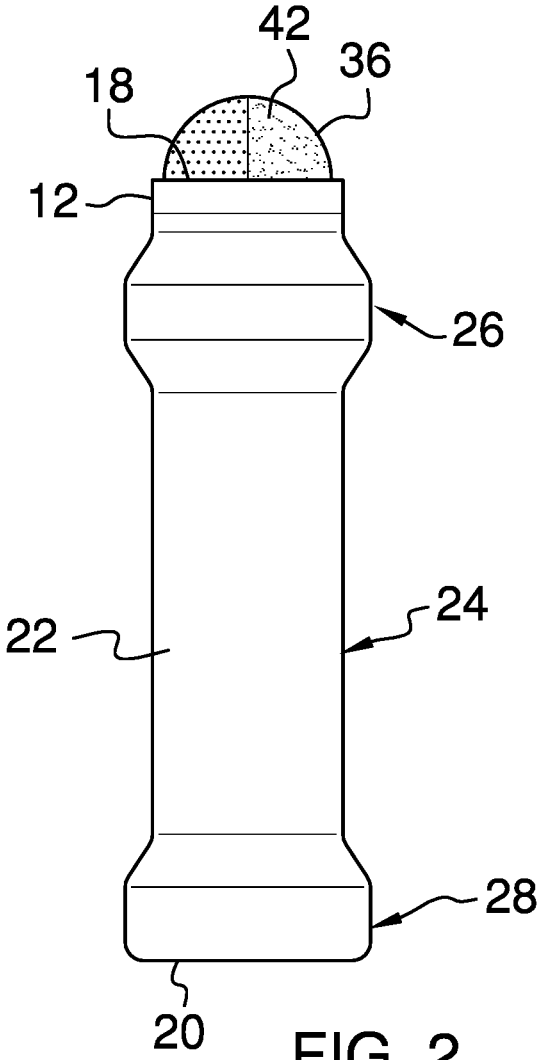
FIG. 2 is a front view of an embodiment of the disclosure.
Figure 3:
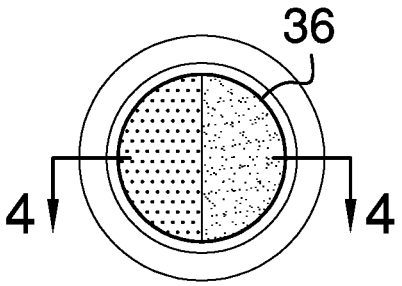
FIG. 3 is a top view of an embodiment of the disclosure.
Figure 4:
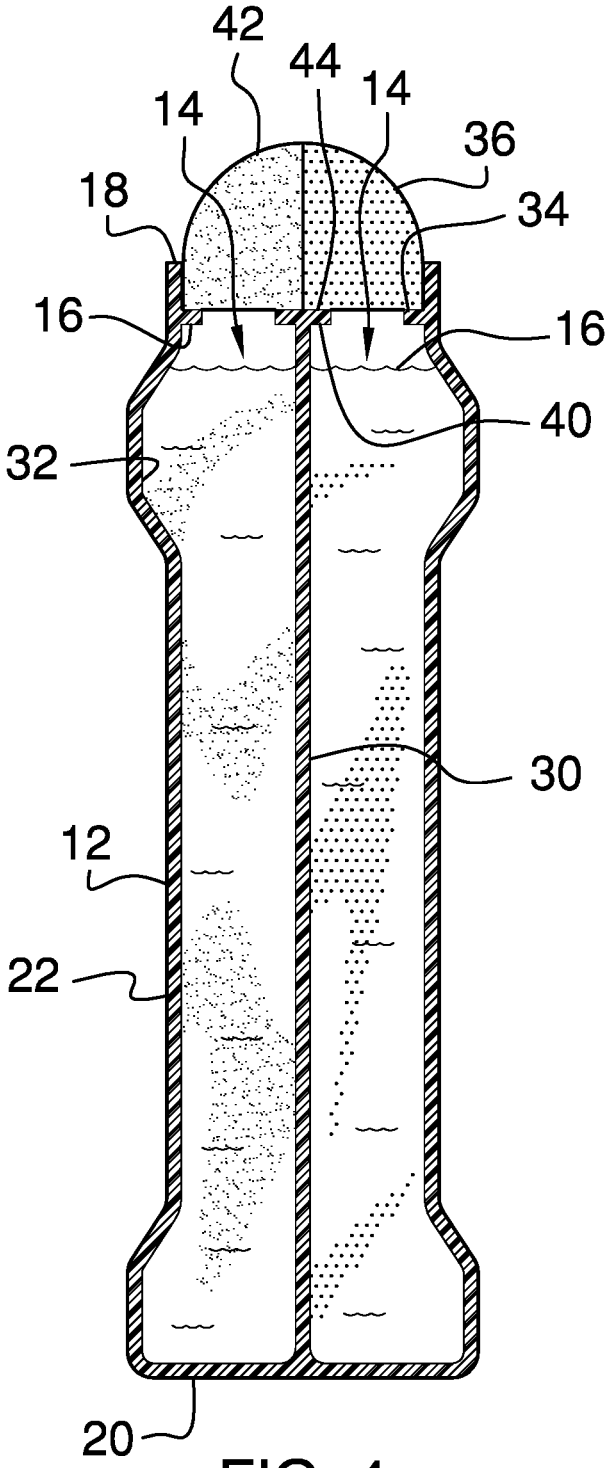
FIG. 4 is a cross sectional view taken along line 3-3 of figure of an embodiment of the disclosure.
Figure 5:
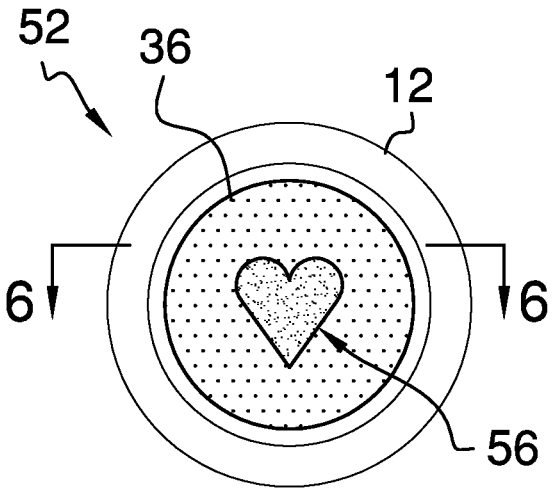
FIG. 5 is a top view of an alternative embodiment of the disclosure.
Figure 6:
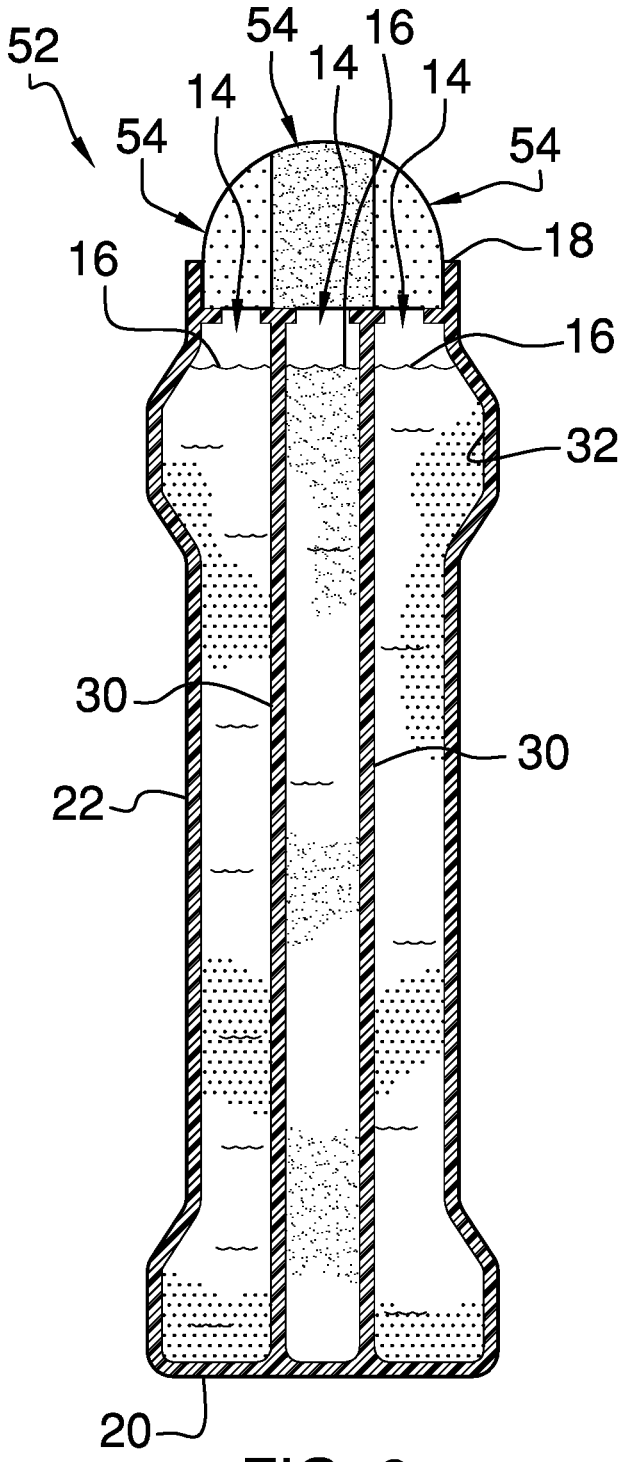
FIG. 6 is a cross sectional view taken along line 6-6 of FIG. 5 of an embodiment of the disclosure.

With reference now to the drawings, and in particular to FIGS. 1 through 6 thereof, a new marker device embodying the principles and concepts of an embodiment of the disclosure and generally designated by the reference numeral 10 will be described.

As best illustrated in FIGS. 1 through 6, the multicolor marker assembly 10 generally comprises a bottle 12 that has a plurality of chambers 14 integrated therein. Each of the chambers 14 contains a fluid pigment 16 of a respective color. The bottle 12 has a top end 18, a bottom end 20 and an outer wall 22 extending therebetween. The top end 18 is open and the outer wall 22 has a central portion 24 extending between an upper portion 26 and a lower portion 28. Each of the upper portion 26 and the lower portion 28 has a diameter that is greater than a diameter of the central portion 24 to enhance gripping the central portion 24. Additionally, the upper portion 26 is spaced downwardly from the top end 18 of the bottle 12.

The bottle 12 has a dividing wall 30 extending between the top end 18 and the bottom end 20. The dividing wall 30 is centrally positioned in the bottle 12 to define the chambers 14 and each of the chambers 14 is fluidly discrete from each other. The outer wall 22 has an inside surface 32 and the inside surface 32 has a lip 34 extending outwardly therefrom. The lip 34 is spaced from the top end 18 and the lip 34 extends around a full circumference of the inside surface 32.

An applicator 36 is provided and the applicator 36 is removably coupled to the bottle 12. The applicator 36 is comprised of a fluid permeable material to absorb the fluid pigment 16 contained in each of the chambers 14. Additionally, the applicator 36 is comprised of a resiliently compressible material such that the applicator 36 releases the fluid pigment 16 in each of the chambers 14 when the applicator 36 is pressed against a surface 38. In this way the applicator 36 can make a mark comprising a plurality of colors. The surface 38 may be a bingo card or any other surface on which a user wishes to make a mark.

The applicator 36 has a bottom side 40 and a top side 42. The bottom side 40 is flattened and the top side 42 is concavely arcuate with respect to the bottom side 40 such that the applicator 36 has a dome shape. The applicator 36 is positioned in the top end 18 of the bottle 12 having the bottom side 40 engaging the lip 34 on the inner surface 38 of the outer wall 22 of the bottle 12 and a platform 44 on the dividing wall 30. The applicator 36 comprises a first half 46 and a second half 48 that each extend between the top side 42 and the bottom side 40. The first half 46 is comprised of a first material and the second half 48 is comprised of a second material. Each of the first half 46 and the second half 48 is aligned with a respective one of the chambers 14 to absorb the fluid pigment 16 contained in the respective chamber 14.

A cap 50 is provided and the cap 50 is positionable over the applicator 36. Thus, the cap 50 inhibits the applicator 36 from releasing the fluid pigment 16. The cap 50 is concavely arcuate for conforming to the curvature of the applicator 36. Additionally, the cap 50 is comprised of a fluid impermeable material. In an alternative embodiment 52 as is most clearly shown in FIGS. 5 and 6, the bottle 12 has a plurality of dividing walls 30 therein defining a plurality of chambers 14 in the bottle 12. Each of the chambers 14 contains a fluid pigment 16 of a respective color. Continuing in the alternative embodiment 52, the applicator 36 is divided into a plurality of portions 54 and each of the portions 54 extends between the top end 18 of the applicator 36 and the bottom end 20 of the applicator 36. Each of the portions 54 is aligned with a respective one of the chambers 14 in the bottle 12 for receiving the fluid pigment 16 therein. The top end 18 has indicia 56 being printed thereon and the indicia 56 may comprise a geometric shape, a preferred image, a word or any other possible indicia that will be rendered when the applicator 36 is pressed against the surface 38.

In use, the bottle 12 is gripped while playing bingo and the applicator 36 is pressed against the appropriate bingo box on a bingo card when the bingo numbers are called. Thus, the applicator 36 leaves a multicolored mark on bingo card. In this way the bottle 12 and the applicator 36 as disclosed enhances the experience of playing bingo compared to markers that leave a mark of a single color. The cap 50 is positioned over the applicator 36 when the applicator 36 is not being used for marking.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A multicolor marker assembly being configured to simultaneously apply a plurality of colored pigments to a surface, said assembly comprising:

a bottle having a plurality of chambers being integrated therein wherein each of said chambers is configured to contain a fluid pigment of a respective color, said bottle having a top end, a bottom end and an outer wall extending therebetween, said top end being open, said outer wall having a central portion extending between an upper portion and a lower portion, each of said upper portion and said lower portion having a diameter being greater than a diameter of said central portion wherein said upper portion and said lower portion are configured to enhance gripping said central portion, said upper portion being spaced downwardly from said top end of said bottle, said outer wall having an inside surface, said inside surface having a lip extending outwardly therefrom, said lip being spaced from the top end, said lip extending around a full circumference of said inside surface;

an applicator being removably coupled to said bottle, said applicator being comprised of a fluid permeable material wherein said applicator is configured to absorb the fluid pigment contained in each of said chambers, said applicator being comprised of a resiliently compressible material such that said applicator releases the fluid pigment in each of said chambers when said applicator is pressed against a surface wherein said applicator is configured to make a mark comprising a plurality of colors; and a cap being positionable over said applicator to inhibit said applicator from releasing said fluid pigments.

2. The assembly according to claim 1, wherein said bottle has a dividing wall extending between said top end and said bottom end, said dividing wall being centrally positioned in said bottle to define said chambers, each of said chambers being fluidly discrete from each other.

3. The assembly according to claim 1, wherein said applicator has a bottom side and a top side, said bottom side being flattened, said top side being concavely arcuate with respect to said bottom side such that said applicator has a dome shape, said applicator being positioned in said top end of said bottle having said bottom side engaging said lip on said inner surface of said outer wall of said bottle.

4. The assembly according to claim 3, wherein said applicator comprises a first half and a second half each extending between said top side and said bottom side, said first half being comprised of a first material, said second half being comprised of a second material, each of said first half and said second half being aligned with a respective one of said chambers wherein each of said first half and said second half is configured to absorb the fluid pigment contained in said respective chamber.

5. A multicolor marker assembly being configured to simultaneously apply a plurality of colored pigments to a surface, said assembly comprising:

a bottle having a plurality of chambers being integrated therein wherein each of said chambers is configured to contain a fluid pigment of a respective color, said bottle having a top end, a bottom end and an outer wall extending therebetween, said top end being open, said outer wall having a central portion extending between an upper portion and a lower portion, each of said upper portion and said lower portion having a diameter being greater than a diameter of said central portion wherein said upper portion and said lower portion are configured to enhance gripping said central portion, said upper portion being spaced downwardly from said top end of said bottle, said bottle having a dividing wall extending between said top end and said bottom end, said dividing wall being centrally positioned in said bottle to define said chambers, each of said chambers being fluidly discrete from each other, said outer wall having an inside surface, said inside surface having a lip extending outwardly therefrom, said lip being spaced from the top end, said lip extending around a full circumference of said inside surface;

an applicator being removably coupled to said bottle, said applicator being comprised of a fluid permeable material wherein said applicator is configured to absorb the fluid pigment contained in each of said chambers, said applicator being comprised of a resiliently compressible material such that said applicator releases the fluid pigment in each of said chambers when said applicator is pressed against a surface wherein said applicator is configured to make a mark comprising a plurality of colors, said applicator having a bottom side and a top side, said bottom side being flattened, said top side being concavely arcuate with respect to said bottom side such that said applicator has a dome shape, said applicator being positioned in said top end of said bottle having said bottom side engaging said lip on said inner surface of said outer wall of said bottle, said applicator comprising a first half and a second half each extending between said top side and said bottom side, said first half being comprised of a first material, said second half being comprised of a second material, each of said first half and said second half being aligned with a respective one of said chambers wherein each of said first half and said second half is configured to absorb the fluid pigment contained in said respective chamber; and a cap being positionable over said applicator to inhibit said applicator from releasing said fluid pigments, said cap being concavely arcuate for conforming to the curvature of said applicator.

6. The assembly according to claim 5, wherein said bottle has a plurality of dividing walls therein defining a plurality of chambers in said bottle, each of said chambers containing a fluid pigment of a respective color.

7. The assembly according to claim 6, wherein said applicator is divided into a plurality of portions, each of said portions extending between said top end of said applicator and said bottom end of said applicator, each of said portions being aligned with a respective one of said chambers in said bottle for receiving the fluid pigment therein.

* * * * *